US007502579B2

(12) United States Patent
Mabuchi et al.

(10) Patent No.: US 7,502,579 B2
(45) Date of Patent: Mar. 10, 2009

(54) DEVELOPING DEVICE USING DEVELOPER OF PARTICULAR PROPERTIES SUITABLE THEREFORE

(75) Inventors: Hiroyuki Mabuchi, Hitachinaka (JP); Masayoshi Nakayama, Hitachinaka (JP); Hirobumi Ooyoshi, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 338 days.

(21) Appl. No.: 11/211,742

(22) Filed: Aug. 26, 2005

(65) Prior Publication Data

US 2006/0045575 A1 Mar. 2, 2006

(30) Foreign Application Priority Data

Aug. 31, 2004 (JP) ..... P2004-251590

(51) Int. Cl.
*G03G 15/09* (2006.01)

(52) U.S. Cl. ..... 399/267; 399/269; 399/274; 399/276

(58) Field of Classification Search ..... 399/267, 399/269, 274, 275, 276, 286
See application file for complete search history.

(56) References Cited

U.S. PATENT DOCUMENTS 4,557,582 A * 12/1985 Kan et al. ..... 399/276
5,729,805 A * 3/1998 Chiba et al. ..... 399/276
5,907,755 A * 5/1999 Takuma et al. ..... 399/269

FOREIGN PATENT DOCUMENTS

JP 2079878 3/1990
JP 2000112226 4/2000

* cited by examiner

*Primary Examiner*—David M Gray
*Assistant Examiner*—Laura K Roth
(74) *Attorney, Agent, or Firm*—Whitham Curtis Christofferson & Cook, PC

(57) ABSTRACT

A developing device is provided with a developer accommodating vessel accommodating developer having as primary components a nonmagnetic toner and magnetic particles referred to as a carrier. The carrier is composed of a magnetic material as a core material that is uniformly covered with an insulating synthetic resin. The toner is mixed with the carrier at a weight ratio to the overall weight of the developer of 3-10%. The carrier has an average particle size of 65 μm or less and a saturation magnetization of at least 70 emu/g. The developing device includes a developing roller and a sleeve roller that rotates about the developing roller. The surface of the sleeve roller is processed with metal shot to achieve a surface roughness of 0.45-1.08 times the average particle size of the carrier, or more specifically a roughness Rz of about 30 μm.

9 Claims, 5 Drawing Sheets

DEVELOPING DEVICE USING DEVELOPER OF PARTICULAR PROPERTIES SUITABLE THEREFORE

BACKGROUND OF THE INVENTION

1. Field of the Invention

The present invention relates to an electrostatic recording device such as an electrophotographic printer, copier, or the like; and a developing device provided in the electrostatic recording device. The present invention particularly relates to a developing device employing a magnetic developer, and an electrostatic recording device in which the developing device is provided.

2. Description of the Related Art

There are electrostatic recording devices such as electrophotographic printers and copiers well known in the art that are configured of a recording member such as a photosensitive drum and a developing device. An electrostatic recording device having this structure performs a printing operation by first charging the surface of the photosensitive drum to a prescribed potential and then exposing the charged surface to light based on image data, thereby forming an electrostatic latent image. The latent image formed on the photosensitive drum is developed into a visible image by supplying a developer called toner from the developing device. Finally, the visible image is transferred and fixed to a recording medium.

One developing device provided in the electrostatic recording device having this structure that is well known in the art includes a developer accommodating vessel, developer conveying member, a developing roller, a developer conveying quantity regulating member, and toner supplying member. The developer used by the developing device is a two-component developer having a prescribed mixture ratio of toner and a magnetic powder called a carrier for charging and conveying the toner. The developer conveying member stirs the developer so that the toner and carrier in the developer rub against each other. By so doing, the toner is charged a prescribed amount and adheres to the carrier.

The toner adhering to the carrier is supplied to the developing roller. The developing roller includes a plurality of magnets provided internally and a sleeve roller capable of rotating about the outer peripheral surface of the developing roller. The carrier and toner are attracted to the developing roller by the force of the magnets and are thereby maintained on the sleeve roller and conveyed by the rotations of the same. Next, the developer passes through a gap formed between the sleeve roller and the developer conveying quantity regulating member, referred to as a doctor blade, disposed near to and opposing the developing roller so that the amount of conveyed developer is restricted to a prescribed quantity.

After being restricted to the prescribed amount of the developer by the doctor blade, the developer is conveyed by the rotation of the sleeve roller to a position opposing the photosensitive drum so as to contact the same. At this time, a bias voltage (hereinafter referred to as a "developing bias") is applied to the developing roller. An electric field formed by interaction of the developing bias and the electrostatic latent image on the photosensitive drum causes the charged toner to be attracted to image-forming positions on the photosensitive drum to develop the latent image.

The area in which the developer carried on the developing roller contacts and develops an image on the photosensitive drum is called the developing area. Since one of the magnets provided in the developing roller is positioned opposite the developing area, the lines of magnetic force produced by the magnets extend in a direction away from the developing roller. Hence, the carrier is linked chain-like along these magnetic lines of force in a direction away from the developing roller. In this way, carrier bristles are erected on the surface of the sleeve roller to form a magnetic brush.

Recently, the size of the carrier particles has been reduced to keep up with demands for higher quality images. Since a smaller carrier size produces finer bristles of developer that slide across the surface of the photosensitive member, it is possible to develop the electrostatic latent images more faithfully and produce images that are less grainy. However, when the size of the carrier particles is reduced, the force that magnetically holds the carrier at the developing area is weaker so that carrier particles are more likely to scatter. In order to prevent the scattering of small carrier particles, the magnetic force holding the particles should be strong enough to reach the ends of the magnetic brush. To achieve this, it is necessary to shorten the length of the bristles in the magnetic brush. When the bristles are short, it is also necessary to reduce a developing gap, defined as the shortest distance between the developing roller and photosensitive drum at the developing area, and a doctor gap, defined as the shortest distance between the doctor blade and the developing roller.

In a developing device disclosed in Japanese patent application publication No. 2000-112226, magnetic poles of different polarity are disposed in the developing roller and a doctor blade is disposed between the magnetic poles at a position that the magnetic polarity reverses. With this structure, the doctor blade cannot uniformly regulate the quantity of developer conveyed through the doctor gap when the size of the doctor gap is reduced, due to irregularities in the doctor gap caused by imprecision in parts processing and assembly.

Further, since a higher quantity of developer is supplied to the developing area, the magnetic brush has a larger mechanical scraping force that can generate lines in the image where the carrier is swept. Conversely, if the quantity of developer on the developing roller is too low by more than a suitable margin, the density of the image may not reach the desired value or may be irregular. Therefore, it is necessary to reduce variations in the quantity of developer on the developing roller caused by irregularities of the doctor gap.

Further, when the doctor gap is reduced, the stress applied to developer passing through the doctor gap increases, leading to problems in maintaining image quality in the long term. Hence, it is necessary to reduce the stress applied to developer in the doctor gap.

Japanese patent application publication No. HEI-2-79878 describes a developing device for resolving these problems. In this developing device, a developer conveying quantity regulating member is disposed opposite a magnetic pole that serves as a conveying pole in the developing roller. With this construction, the developer conveying quantity regulating member ensures that a smaller amount of developer is conveyed even when the doctor gap is relatively wide. Hence, this construction reduces variations in the quantity of conveyed developer caused by irregularities in the doctor gap and reduces the stress applied to the developer passing through the developer conveying quantity regulating member, thereby achieving high quality images that are stable in the long term.

In recent years, there has been increased demand for higher quality images on devices that print at a high rate of speed, generating a desire to develop a developing device that uses even smaller carrier particles. Since the developing roller must rotate at a higher velocity in high-speed printing devices, carrier particles tend to scatter more than in low speed printing devices. For this reason, such developing devices generally use a developing roller whose sleeve surface has a high maximum magnetic flux density, and a high carrier having a saturation magnetization.

However, when a developing roller with a high maximum magnetic flux density and a carrier with a high saturation magnetization are used in the developing device described above having the developer conveying quantity regulating member disposed opposite the magnetic conveying pole and having a doctor gap set to the width described in Japanese patent application publication No. HEI-2-79878, developer tends to slip on the surface of the sleeve roller at a position opposing the developer conveying quantity regulating member. As a result, the developer that slips on the surface of the sleeve roller does not pass the doctor gap, leading to a drop in printing density and scattered carrier particles. To resolve this problem, the developing gap must be greatly increased.

Some conventional developing devices also employ a means called an auger or an auger screw that uses a rotating spiral screw to continuously supply developer to the developing roller by conveying the developer along the axial direction of the screw. With this developing device, developer conveyed by the auger is transferred to the developing roller and subsequently returned to the auger after the toner in the developer has been consumed in the developing process. Since the developer is gradually conveyed downstream in the conveying direction as this process is repeated, the density of toner in the developer gradually decreases toward the downstream end in the conveying direction.

Here, it is necessary to supply sufficient toner to areas farthest downstream in the conveying direction of the developer in order to maintain toner density when printing high-density images, such as a solid image that covers the entire surface of the paper. However, devices that print at high speeds consume a large amount of toner per unit time. Accordingly, if it is not possible to supply developer having a sufficient quantity of toner, problems such as a reduced printing density and carrier deposition may occur. Further, a large amount of toner is tried to supply, the toner cannot be adequately mixed with the carrier to produce a suitable charge, resulting in ghost images and toner scatter.

SUMMARY OF THE INVENTION

In view of the foregoing, it is an object of the present invention to provide a developing device capable of maintaining excellent image quality over a long period of time when printing images at a high rate of speed with a large amount of toner, without such problems as a drop in printing density and scattering of carrier particles.

To achieve the above and other objects, the present invention provides a developing device for developing an electrostatic latent image formed on a surface of a recording member. The developing device includes a developer accommodating vessel, a developer conveying member, and a developing roller.

The developer accommodating vessel for accommodating developer has a toner and a carrier as primary components. The developer conveying member Is disposed in the developer accommodating vessel to convey the developer in a direction. The developing roller opposes at one side the recording member and at another side the developer conveying member and having an axis. The developing roller includes a cylindrical part having a peripheral surface and a plurality of magnets of differing polarity, and a sleeve roller disposed on the peripheral surface of the cylindrical part and capable of rotating about the axis for supplying the developer from the developer conveying member to the recording member.

The carrier has an average particle size of not greater than 65 μm and a saturation magnetization of not less than 70 emu/g. The surface of the sleeve roller has a roughness of not less than 0.45 times an average particle size of the carrier.

The present invention also provides an electrostatic recording device including a recording member, a charging unit, an exposing unit, a developing device as described above, and a transferring unit.

The recording member has a surface on which an electrostatic latent image is formed and developer is deposited. The charging unit charges the recording member. The exposing unit irradiates light onto the charged recording member. The transferring unit transfers the toner image onto a recording medium.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE PREFERRED EMBODIMENTS

Figure 1:
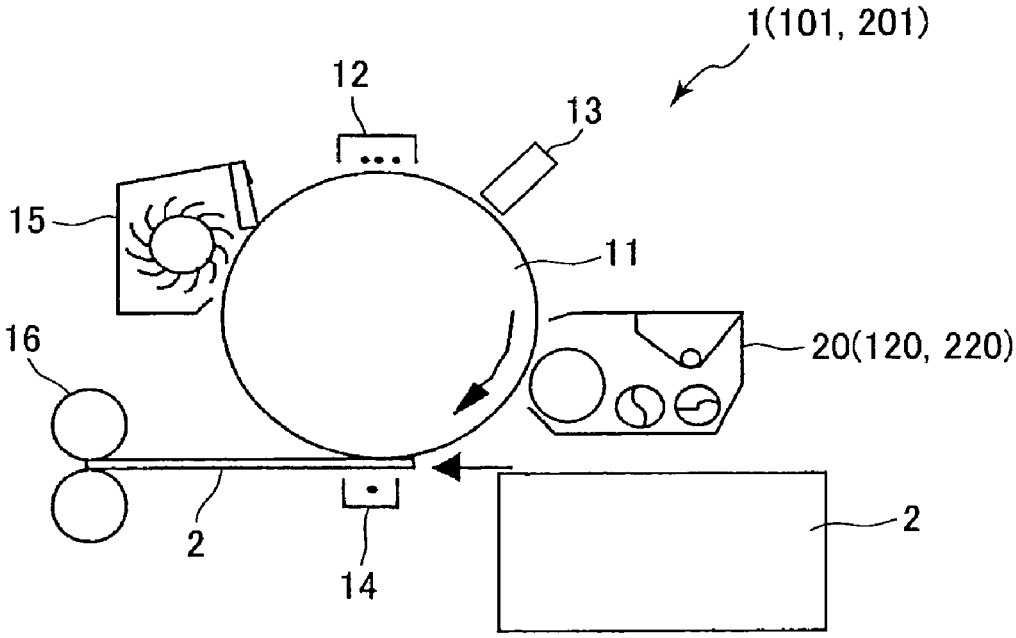
FIG. 1 is a schematic diagram of an electrostatic recording device according to a first embodiment of the present invention.

A developing device and an electrostatic recording device according to a first embodiment of the present invention will be described while referring to FIGS. 1 through 6. As shown in FIG. 1, an electrostatic recording device 1 includes a photosensitive drum 11, a charger 12, an exposing unit 13, a transfer unit 14, a cleaner 15, a fixing unit 16, and a developing device 20. The photosensitive drum 11 functions to carry an electrostatic latent image formed on the surface thereof. The charger 12 applies an electric charge to the photosensitive drum 11. The exposing unit 13 irradiates light on the photosensitive drum 11 after the photosensitive drum 11 has been charged by the charger 12. The transfer unit 14 transfers a toner image formed on the photosensitive drum 11 to a recording medium 2, such as paper. The cleaner 15 removes toner from the photosensitive drum 11 after the toner image has been transferred. The fixing unit 16 melts the toner image transferred onto the recording medium 2 to fix the toner image thereon.

In an image-forming operation, the photosensitive drum 11 is rotated in the clockwise direction of FIG. 1 so that the circumferential velocity of the photosensitive drum 11 (hereinafter referred to as "processing speed") is at least 300 mm/s. Next, the charger 12 applies a uniform charge of −600 V to the surface of the photosensitive drum 11. An LED or other light source (not shown) provided in the exposing unit 13 exposes the surface of the photosensitive drum 11 to form a latent image so that the image areas have a potential of −50 V, while the background areas remain at a potential of −600 V. As the photosensitive drum 11 continues to rotate and the latent image arrives at the position of the developing device 20, the developing device 20 supplies a developer 3 (FIG. 2) to the surface of the photosensitive drum 11 within a prescribed developer supply range. Toner in the developer 3 becomes attached to image areas within the developer supply range, that is, areas that were exposed by the exposing unit 13, thereby forming a toner image on the photosensitive drum 11.

As the photosensitive drum 11 continues to rotate, the toner image formed on the photosensitive drum 11 arrives at the position of the transfer unit 14. One sheet of the recording medium 2 is simultaneously conveyed to a position between the transfer unit 14 and the photosensitive drum 11. The transfer unit 14 transfers the toner image onto the recording medium 2, and the fixing unit 16 subsequently fixes the toner image to the recording medium 2. The cleaner 15 removes any toner remaining on the photosensitive drum 11 after the transfer unit 14 has transferred the toner image to the recording medium 2. The cleaner 15 collects and disposes the residual toner. Since the processing speed is 300 mm/s as described above, the electrostatic recording device 1 can print 85 ppm of a continuous sheet having a width equivalent to an A4-size paper or 70 ppm when printing on cut sheets with a gap of 50 mm between sheets.

Figure 2:
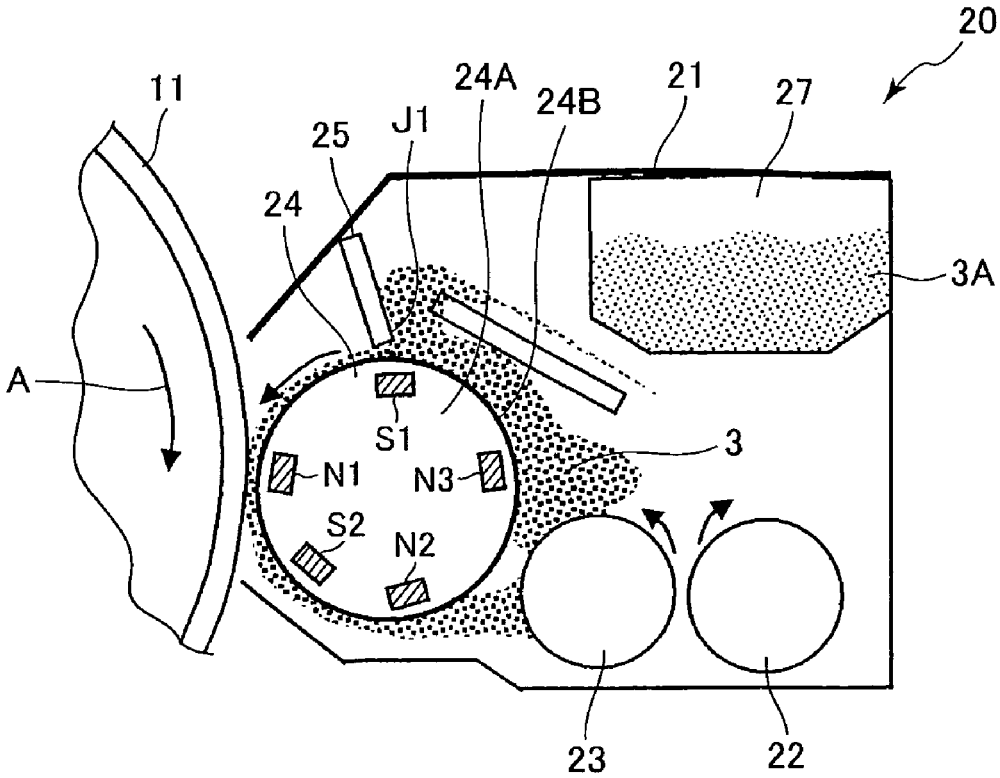
FIG. 2 is a schematic diagram showing a developing device according to the first embodiment.

Next, the structure and operations of the developing device 20 will be described. As shown in FIG. 2, the developing device 20 includes a developer accommodating vessel 21, a first screw 22, a second screw 23, a developing roller 24, and a motor (not shown). The motor is linked to the first screw 22, second screw 23, and developing roller 24 via a drive transfer mechanism (not shown) configured of gears and the like.

The developer accommodating vessel 21 accommodates the developer 3 having the primary components of a nonmagnetic toner and magnetic particles called a carrier. The carrier has a magnetic core material, the surface of which is uniformly coated with an insulating synthetic resin. The synthetic resin has a suitable tribocharging property for the toner. The toner is mixed in the developer 3 at a weight ratio of 3-10%. The carrier has an average particle size of at most 65 μm and a saturation magnetization of 70 emu/g or greater.

Figure 3:
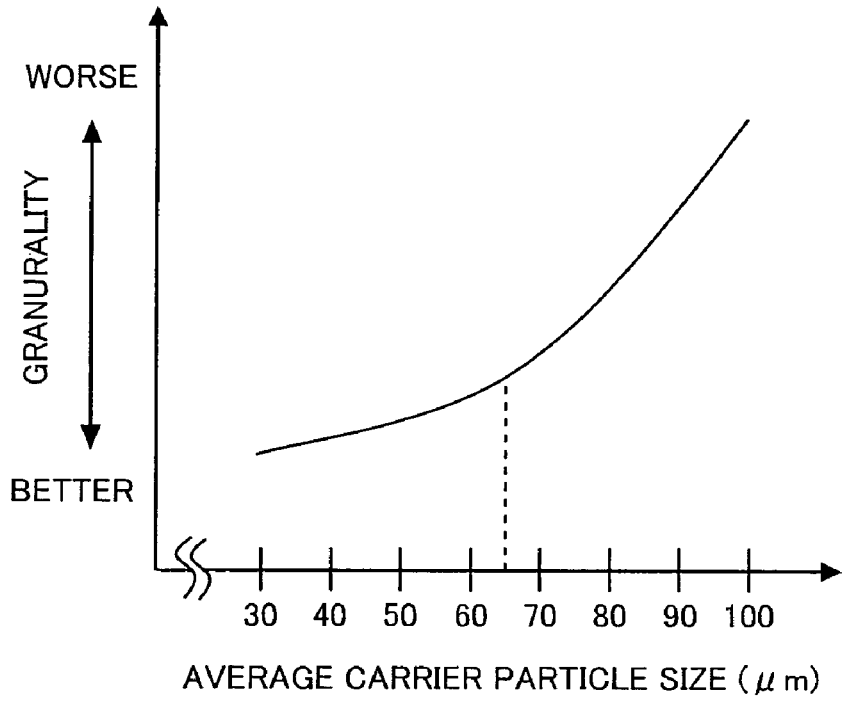
FIG. 3 is a graph illustrating the relationship between carrier particle size and granularity of a printed image.

Generally, a smaller particle size of the carrier produces high density bristles of the developer 3 that slide over the surface of the photosensitive drum 11, enabling the latent image to be developed more faithfully. The graph in FIG. 3 shows the effects of reducing carrier particle size on improving the granular quality of an image. As shown in the graph, the improvement is great when the particle size is 65 μm or more and small when the particle size is less than 65 μm. Since image graininess is a subjective evaluation, the level at which this graininess is felt differs according to the individual. However, images capable of satisfying most people are obtained when the carrier particle size is 65 μm or less. Hence, as described above, the carrier used in the preferred embodiment has a particle size of 65 μm or less.

Figure 4:
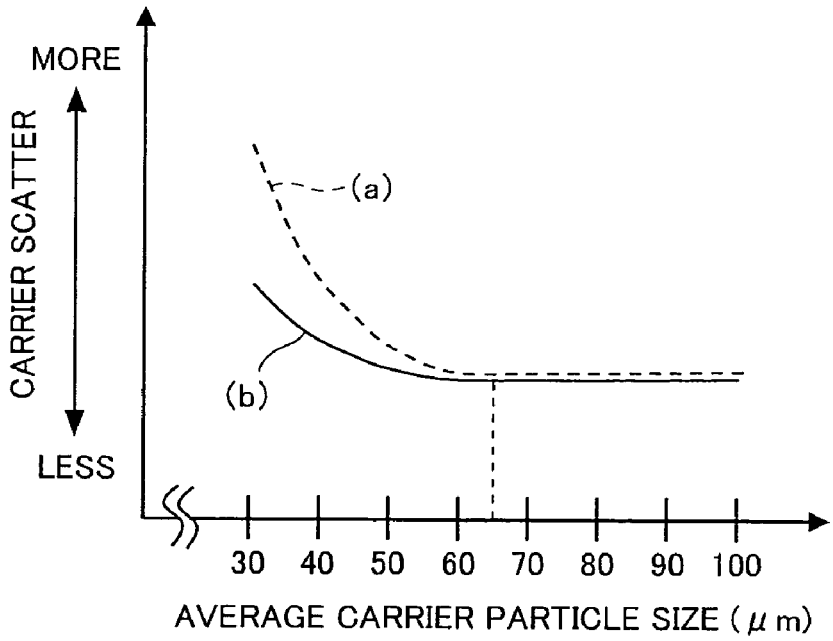
FIG. 4 is a graph illustrating the relationship between average carrier particle size and carrier scatter.

The graph in FIG. 4 shows the general characteristics of carrier scatter when the saturation magnetization of the carrier is about 60 emu/g and about 70 emu/g. In FIG. 4, the characteristics (a) indicate a carrier having a saturation magnetization of 60 emu/g, while the characteristics (b) indicate a carrier having a saturation magnetization of 70 emu/g. Carrier scatter in both cases has an increasing trend when the particle size is decreased. However, the carrier having the high saturation magnetization has stronger magnetic retention than the carrier having the low saturation magnetization, and is capable of restraining carrier scatter. Hence, the saturation magnetization of the carrier in the preferred embodiment is set at 70 emu/g or greater, as described above. Here, the developing area is the region of the photosensitive drum 11 contacted and developed by developer 3 carried on the developing roller 24.

The average particle size of the carrier can be measured by commercially available particle size distribution measurement devices using laser diffraction or laser scattering method, such as Microtrac particle size distribution measurement device (NIKKISO) or ELOS&RODOS (Sympatec GmbH).

The saturation magnetization refers to magnetization reached when magnetization of the carrier no longer changes with respect to a change in a magnetic field applied to the carrier. The saturation magnetization of the carrier is measured at room temperature by commercially available measurement devices, such as Vibrating Sample Magnetometer or B-H analyzer.

Some example core materials of the carrier are magnetite, Mn—Mg ferrite, and Cu—Zn ferrite. The toner becomes fused to the surface of the carrier if the carrier incurs stress in the developing device 20 over a long period of time. Further, the insulating resin of the carrier frays or peels from the surface of the core material by the carrier incurring stress over a long time period, thereby changing the tribocharging property of the carrier surface toward the toner. As a result, a uniform charge cannot be maintained on the developer 3, leading to a decline in printing quality. In a relatively fast electrostatic recording device 1 with a processing speed that exceeds 300 mm/s, rotating members in the developing device 20 such as the developing roller 24, first screw 22, and second screw 23 rotate at a faster rate, increasing the stress incurred by the developer 3 in the developing device 20. As a result, the insulating synthetic resin coating the core material of the carrier is more likely to peel off the core material, leading to a deterioration in the developer quality.

Magnetite described above as an example core material for the carrier has an irregular surface, increasing the area of contact with the insulating resin coating the surface and achieving better adhesion with this insulating resin. Hence, it is desirable to use magnetite as the core material of the carrier to extend the life of the developer. Under actual high-stress conditions designed to cause insulating resin to peel from the core material, it was confirmed that the insulating resin did not peel when using a magnetite core material. Hence, it was confirmed that the carrier extended the life of the developer.

The toner is mixed with the carrier at a weight ratio of 3-10% the overall weight of the developer 3. However, since only toner in the developer 3 is expended during a printing operation performed by the electrostatic recording device 1, the weight percentage of toner in the developer 3 accommodated in the developing device 20 decreases. For this reason, a toner 3A is supplied into the developing device 20 from a toner replenishing device 27 described later. The supplied toner 3A is combined and conveyed along with the developer 3 in the developing device 20 by the first screw 22 and second screw 23.

As shown in FIG. 2, the first screw 22 and second screw 23 are substantially cylindrical in shape and are disposed so that their rotational axes are substantially parallel to the axis of the photosensitive drum 11. The first screw 22 and second screw 23 are disposed opposite one another in close proximity within the developer accommodating vessel 21 such that their rotational axes are positioned on the same horizontal plane.

As shown in FIG. 2, a toner replenishing device 27 is disposed almost directly above the first screw 22. The toner replenishing device 27 can supply the toner 3A into the developer accommodating vessel 21 from a position almost directly above the first screw 22.

The developing roller 24 is positioned between the photosensitive drum 11 and the second screw 23. The developing roller 24 is substantially cylindrical in shape and includes a cylindrical part 24A and a sleeve roller 24B. The sleeve roller 24B is provided around the periphery of the cylindrical part 24A and is capable of rotating about the axis of the cylindrical part 24A. The developing roller 24 confronts both the photosensitive drum 11 and the second screw 23. The axis of the developing roller 24 is parallel to the axes of the photosensitive drum 11, first screw 22, and second screw 23. The rotation of the sleeve roller 24B conveys the developer 3 supplied from the second screw 23 onto the photosensitive drum 11.

Five permanent magnets indicated by poles S1, N1, S2, N2, and N3 in FIG. 2 are positioned at prescribed intervals around the circumference of the developing roller 24 at positions inside the developing roller 24 and near the surface of the same. The five permanent magnets attract the developer 3 to the surface of the sleeve roller 24B so that the developer 3 can be conveyed on the surface of the same. The magnets are arranged counterclockwise around the circumference of the sleeve roller 24B in the order S1, N1, S2, N2, and N3. The S1 pole is positioned across from a developer conveying quantity regulating member 25 described later.

The N1 pole facing the photosensitive drum 11 has a maximum magnetic-flux density of about 0.07 T at the surface of the sleeve roller 24B, while the other permanent magnets have magnetic forces of about 0.04-0.06 T. The sleeve roller 24B rotates in the counterclockwise direction in FIG. 2 in order to supply the developer 3 conveyed from the second screw 23 onto the photosensitive drum 11. Setting the maximum magnetic-flux density at about 0.07 T enables the force that magnetically holds the carrier to be effective to the ends of the magnetic brush, thereby suppressing the scattering of carrier having a small particle size.

The developer conveying quantity regulating member 25, which is also referred to as a doctor blade, opposes the sleeve roller 24B in close proximity directly above the developing roller 24. The smallest distance between the sleeve roller 24B and the developer conveying quantity regulating member 25 is referred to as the doctor gap. The doctor gap regulates the amount of developer 3 that the sleeve roller 24B supplies onto the photosensitive drum 11 at a prescribed amount as the developer 3 passes through the gap. The doctor gap is set at 0.5 mm.

Figure 5:
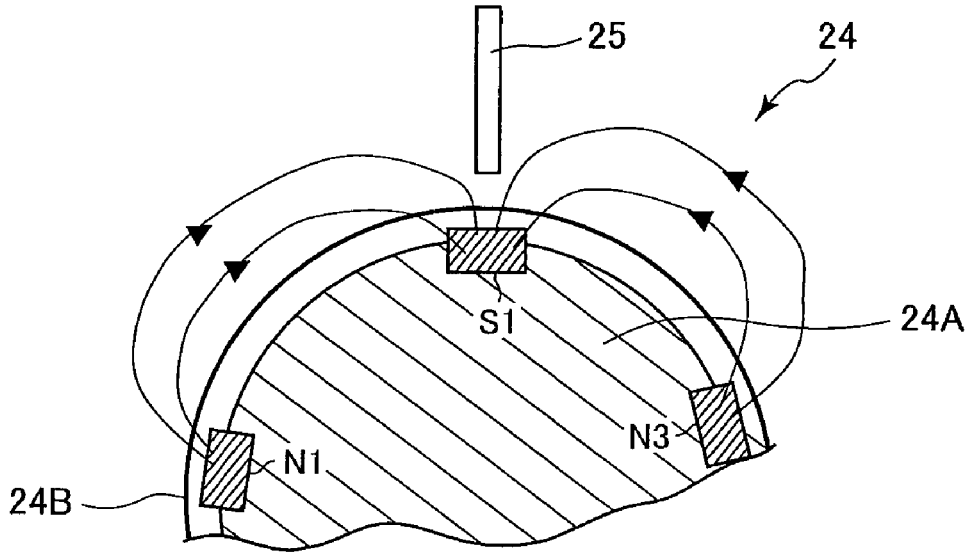
FIG. 5 is a cross-sectional view of a developing roller in the developing device of the first embodiment showing the magnetic lines of force generated by the developing roller.

As shown in FIG. 2, the S1 pole serving as a conveying pole is disposed in the developing roller 24 at a position opposing the developer conveying quantity regulating member 25. As shown in FIG. 5, since the lines of magnetic force generated by the S1 pole have a large normal component in the doctor gap with respect to the surface of the developing roller 24, the bristles of the developer 3 are erected and the developer 3 is less dense. Since the developer 3 is restricted by the developer conveying quantity regulating member 25 at this position, the amount of developer passing through the doctor gap can be reduced.

In other words, by providing the S1 pole serving as a conveying pole in the developing roller 24 at a position opposing the developer conveying quantity regulating member 25, the doctor gap can be enlarged while conveying a prescribed amount developer 3 on the sleeve roller 24B since the developer 3 is less dense in the doctor gap. By enlarging the doctor gap in this way, it is possible to reduce the effect of irregularities in the doctor gap caused by imperfections in processing and assembly.

As indicated by the arrows denoting lines of magnetic force in FIG. 5, the magnetic lines of force running from the S1 pole opposite to the developer conveying quantity regulating member 25 to the N3 pole upstream from the developer regulating position with respect to the rotational direction of the developing roller 24 hold the developer 3 on the sleeve roller 24B at a position upstream from the developer regulating position. Hence, the magnetic binding force acting on the developer 3 is relatively weak at a position upstream from the developer regulating position with respect to the rotational direction of the developing roller 24 since the S1 and N3 poles have magnetic forces of about 0.04-0.06 T, resulting in less stress applied to the developer 3.

In the preferred embodiment, the surface of the sleeve roller 24B is processed with metal shot to achieve a roughness between 0.45 and 1.08 times the average particle size of the carrier, or more specifically a roughness Rz of about 30 μm. A roughness of 0.62-0.93 times the average carrier particle size is even more preferable for the surface of the sleeve roller 24B.

The roughness Rz is a ten-point average roughness based on JIS B0601' 94. The ten-point average roughness Rz is defined by a sum of: a first average of the first through fifth highest peak relative to the average line; and a second average of the first through fifth deepest valleys relative to the average line. The roughness Rz can be measured by roughness measurement devices, such as Surfcom (Tokyo Seimitsu) or Talysurf (Taylor Hobson).

Figure 6:
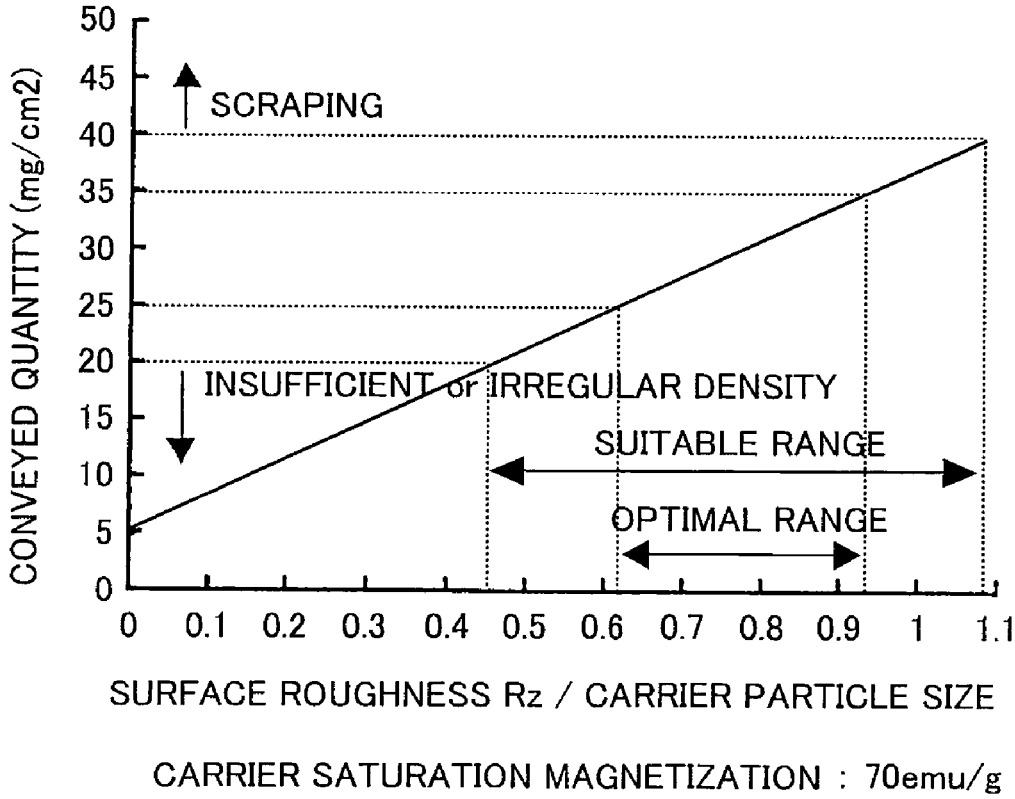
FIG. 6 is a graph illustrating the relationship between the amount of conveyed toner, and ratio of the surface roughness of a sleeve roller and average carrier particle size.

FIG. 6 illustrates why the surface roughness of the sleeve roller 24B is set between 0.45 and 1.08 times the average carrier particle size. When the surface roughness is less than 0.45 times the average particle size, the developer 3 slips on the surface of the sleeve roller 24B upstream of the developer conveying quantity regulating member 25 in the rotational direction of the sleeve roller 24B and, hence, the amount of the developer 3 that passes the developer regulating position is not uniform. Further, if the surface roughness of the sleeve roller 24B exceeds 1.08 times the average particle size of the carrier, a larger amount of developer 3 is conveyed, increasing the fill ratio in the developing area. As a result, the magnetic brush has a larger mechanical scraping force that can produce carrier sweeping lines and the like in the image. The saturation magnetization of the carrier in FIG. 6 is 70 emu/g. By setting the surface roughness of the sleeve roller 24B greater than or equal to 0.45 times the average carrier particle size, a stable amount of developer can be supplied to the developing roller 24, even when the saturation magnetization is greater than or equal to 70 emu/g and the carrier particle size is 65 μm or less. Further, high quality images can be printed over a long period of time with no carrier scatter and low stress applied to the developer 3, even when printing at a high speed of 300 mm/s or greater.

In particular, the electrostatic recording device 1 of the preferred embodiment can print color images at a high rate of speed, while maintaining a high printing quality over a long period of time, without a drop in printing density and without carrier scatter or the like. Hence, the electrostatic recording device 1 of the preferred embodiment can perform full-color printing at a low cost.

During an image-forming operation, the first screw 22 and second screw 23 agitate the developer 3 so that the toner and the carrier in the developer 3 rub against each other, generating a prescribed charge between −10 and −30 μc/g. When the developer 3 charged to this value is brought near the developing roller 24, the developer 3 is attracted to the surface of the sleeve roller 24B by the N3 pole. The rotating sleeve roller 24B then conveys the developer 3 to the position of the S1 pole across from the developer conveying quantity regulating member 25. While the photosensitive drum 11 rotates clockwise in FIG. 2, as indicated by the arrow A, the sleeve roller 24B rotates counterclockwise in FIG. 2 with a peripheral speed of 1.1-2.0 times the peripheral speed of the photosensitive drum 11.

After the developer conveying quantity regulating member 25 regulates the amount of developer 3 being conveyed at a conveying quantity regulating position J1 (see FIG. 2), the developer 3 is conveyed to the developing area. At the developing area, the N1 pole produces bristles from the developer 3 that rub over the surface of the photosensitive drum 11 as the sleeve roller 24B rotates counterclockwise and the photosensitive drum 11 rotates clockwise. A developing bias is applied to the developing roller 24 so that only toner from the developer 3 on the developing roller 24 is supplied to the latent image on the photosensitive drum 11, thereby forming a visible image on the photosensitive drum 11. Subsequently, the developer 3 passes the developing area and is conveyed between like poles N2 and N3. A repelling magnetic field generated between the poles N2 and N3 strips the developer 3 from the developing roller 24, and the developer 3 returns to the second screw 23 to be recurred in the developing device 20. In the meantime, the transfer unit 14 transfers the visible image formed on the photosensitive drum 11 onto the recording medium 2, after which the image is fixed to the recording medium 2 by the fixing unit 16.

It is noted that charged amount of the toner can be measured by a device with a suction Faraday cage method, such as Trek's Charge-to-Mass Ratio System Model 210HS-2A (Trek Japan). Specifically, a toner is sucked from about 200 g of the developer sampled from the developing device through a mesh whose mesh size is 26 μm, the charged amount of the toner per weight is calculated using amount of electric charge of the carrier when change of the displayed amount of electric charge of the carrier is lost.

Next, a developing device 120 and an electrostatic recording device 101 according to a second embodiment of the present invention will be described with reference to FIGS. 7 and 8. Since the electrostatic recording device 101 according to the second embodiment differs from the electrostatic recording device 1 according to the first embodiment only in the structure of the developing device 120, only the developing device 120 will be described below. Unlike the developing device 20 of the first embodiment, the developing device 120 according to the second embodiment includes two developing rollers, the first developing roller 24 and a second developing roller 28. The developing device 120 is also provided with a conveying member 26 for conveying the developer 3 from the second screw 23 to the first developing roller 24 and second developing roller 28.

As in the first embodiment, the developing device 120 includes a motor (not shown) linked to the first developing roller 24, second developing roller 28, and conveying member 26 via a drive transfer mechanism (not shown) that includes gears and the like for driving the first developing roller 24, second developing roller 28, and conveying member 26.

Figure 7:
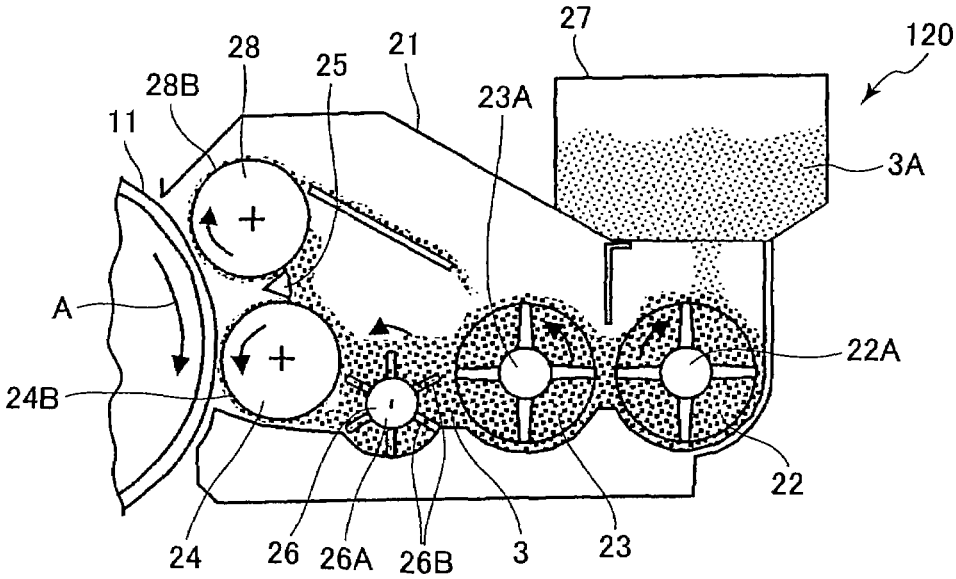
FIG. 7 is a schematic diagram showing a developing device according to a second embodiment of the present invention.

The conveying member 26 is disposed on the left of the second screw 23 in FIG. 7. The conveying member 26 includes a rotational shaft 26A and six plate members 26B extending radially from the rotational shaft 26A. The first screw 22 and second screw 23 also possess rotational shafts 22A and 23A, respectively, oriented parallel to the rotational shaft 26A. The conveying member 26 is configured to rotate counterclockwise in FIG. 7 for conveying developer 3 from the second screw 23 toward the first developing roller 24 and second developing roller 28.

The first developing roller 24 is disposed to the left of the conveying member 26 in FIG. 7, while the second developing roller 28 is disposed almost directly above the first developing roller 24. Both the first developing roller 24 and the second developing roller 28 are substantially cylindrical in shape. The first developing roller 24 faces the second screw 23 with the conveying member 26 interposed therebetween. Both the first developing roller 24 and second developing roller 28 are positioned opposite the photosensitive drum 11. The axes of the first developing roller 24 and second developing roller 28 are oriented parallel to the axes of the photosensitive drum 11, first screw 22, and second screw 23.

The sleeve roller 24B of the first developing roller 24 rotates counterclockwise in FIG. 7. Like the first developing roller 24, the second developing roller 28 includes a cylindrical part 28A and a sleeve roller 28B that rotates around the periphery of the cylindrical part 28A clockwise in FIG. 7. The outer surfaces of the sleeve roller 24B and sleeve roller 28B move in the same direction at the position that the first developing roller 24 and second developing roller 28 oppose one another. The peripheral speed of the sleeve roller 24B and sleeve roller 28B is identical to that for the first developing roller 24 in the first embodiment.

Figure 8:
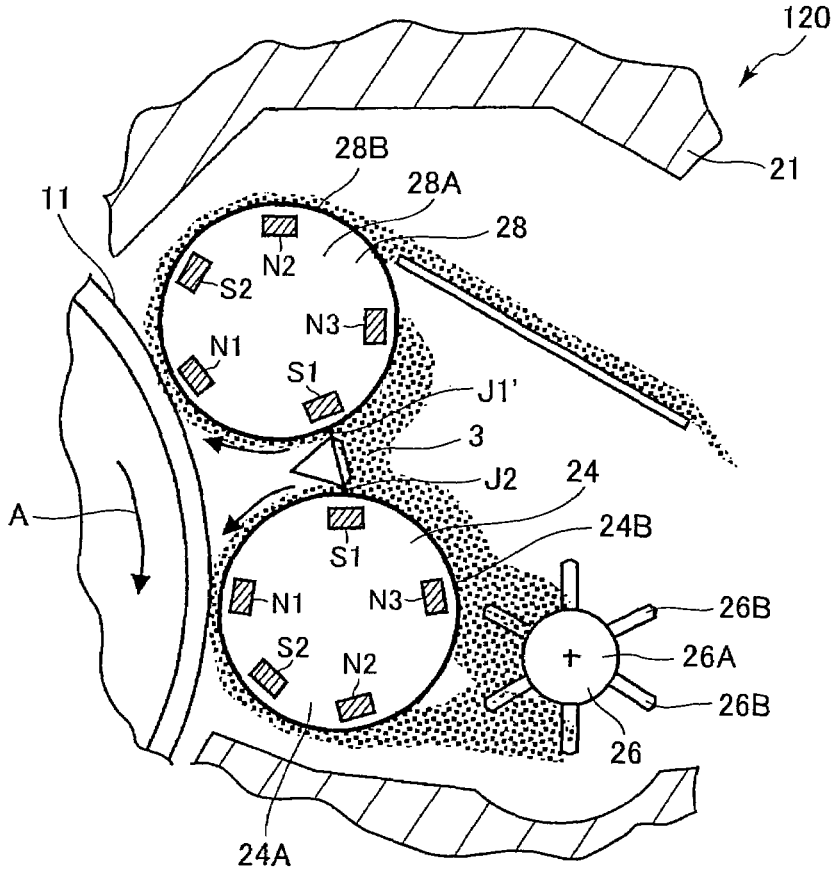
FIG. 8 is a cross-sectional view showing the developing device according to the second embodiment.

As in the first embodiment, five permanent magnets, including the S1, N1, S2, N2, and N3 poles are disposed in the first developing roller 24 near the surface of the same and spaced at prescribed intervals around the circumference of the first developing roller 24, as shown in FIG. 8. Similarly, five permanent magnets are also disposed in the second developing roller 28 near the surface of the same and are spaced at prescribed intervals around the circumference of the second developing roller 28. However, the five permanent magnets in the second developing roller 28 are arranged in the order S1, N1, S2, N2, and N3 in the clockwise direction in FIG. 8, whereas the magnets in the first developing roller 24 are arranged in the same order counterclockwise. The S1 poles in the first developing roller 24 and the second developing roller 28 are both disposed at positions opposite the developer conveying quantity regulating member 25.

The developer conveying quantity regulating member 25 in the second embodiment is shaped differently from that described in the first embodiment. As shown in FIG. 8, the developer conveying quantity regulating member 25 when viewed along the axis of the first developing roller 24 is shaped substantially like an isosceles triangle to form a "double-edged doctor blade." The two base angles of the isosceles triangle oppose the S1 poles of the first developing roller 24 and second developing roller 28 respectively. With this construction, the corners at the base angles of the triangle regulate the amount of developer 3 conveyed onto the first developing roller 24 and the second developing roller 28. The vertex angle of the isosceles triangle points toward the photosensitive drum 11.

The developing device 120 having this construction satisfies the expression $10*V(cm/s)*L(cm)*M(g/cm^2)<W(g/s)<40*V(cm/s)*L(cm)*M(g/cm^2)$, where W is the flow rate of toner conveyed along the rotational axis of the second screw 23, V is the circumferential processing speed for the peripheral surface of the rotating photosensitive drum 11, L is the width of developer 3 onto the first developing roller 24 and second developing roller 28 with respect to their axial direction, and M is the amount of toner on the photosensitive drum 11. The expression V(cm/s)*L(cm)*M(g/cm$^2$) is the amount of toner consumed per unit time in the printing operation.

Since more toner is expended in the developing process when the processing speed is faster, the concentration of toner in the developer drops when printing continuously, even when high-quality printing has been specified at the beginning of the printing operation, resulting in such problems as reduced print density and carrier scatter. Such problems are even more likely to occur in devices that print at high densities, such as full-color printers, because the amount of toner supplied to the first developing roller 24 and second developing roller 28 is less than the amount consumed in the printing operation or is not uniform. However, the developing device 120 is configured to supply developer 3 to the first developing roller 24 and second developing roller 28 while the first screw 22 and second screw 23 convey the developer 3 in the axial direction, and was found capable of resolving above problems when the following expression is satisfied: 10*V(cm/s)*L(cm)*M(g/cm$^2$)<W(g/s)<40*V(cm/s)*L(cm)*M(g/cm$^2$). In other words, the conveying member 26 in the developing device 120 is capable of conveying more than ten times the amount of toner consumed per unit time in the printing operation.

However, if the conveying member 26 conveys more than 40 times the amount of toner consumed in the printing process, the charge of the conveyed toner falls out of the suitable range, leading to such problems as ghost images, accelerated deterioration of the developer 3, and difficulty in maintaining image quality over a long period of time. By maintaining the amount of conveyed toner in the range described above, it has been confirmed that the developing device 120 can print high-quality images without carrier scatter or the like, even at a processing speed of 700 mm/s, and can maintain this image quality over a long period of time.

During an image-forming operation, the first screw 22 and second screw 23 agitate the developer 3 so that the toner and carrier in the developer 3 rub against one another, charging the developer 3 to a prescribed value between −10 and −30 μc/g. The developer 3 having this charge is conveyed near the first developing roller 24 and attracted to the surface of the sleeve roller 24B by the N3 pole. The sleeve roller 24B rotates and conveys this toner to the position of the S1 pole opposite the developer conveying quantity regulating member 25.

Before being conveyed to the developing area, the developer 3 is regulated to a prescribed amount at the conveying quantity regulating position J2 (see FIG. 8) of the developer conveying quantity regulating member 25 so as to occupy 20-40% of the volume in the developing area. The excess developer 3 that is prevented from passing by the developer conveying quantity regulating member 25 is attracted to the surface of the sleeve roller 28B by the magnetic force of the S1 pole of the second developing roller 28. The excess developer 3 is regulated to the same prescribed amount as that conveyed on the first developing roller 24 at the regulating position J1' (see FIG. 8) by the developer conveying quantity regulating member 25. Subsequently, the developer 3 is conveyed to the developing area of the second developing roller 28 at the N1 pole as the sleeve roller 28B rotates. The magnetic poles N1 at the developing areas of the first developing roller 24 and second developing roller 28 form bristles in the developer 3. At the second developing roller 28, the bristles rub across the surface of the photosensitive drum 11 in a direction opposite the moving direction of the surface of the photosensitive drum 11. At the first developing roller 24, the bristles rub across the surface of the photosensitive drum 11 in the same direction that the surface of the photosensitive drum 11 is moving.

By rotating the first developing roller 24 and second developing roller 28 as described above, the developer 3 having a regulated toner concentration can be continuously supplied to the photosensitive drum 11. A developing device having this construction can achieve better developing performance than a developing device combining a plurality of developing rollers that rotate in the same direction for transferring developer from the second developing roller disposed almost vertically above the first developing roller to the first developing roller. The developing device 120 according to the second embodiment performs about 30% better than the above-described developing device having rollers that rotate in the same direction.

The first developing roller 24 and second developing roller 28 convey the developer 3 across the surface of the photosensitive drum 11 in opposite directions from each other at the developing area, producing a high-quality image without producing directionality in the image in the sliding direction, which directionality can be caused by flaws in the front or rear edge of the image in the sliding direction.

At a processing speed of about 300 mm/s, the developing device 20 according to the first embodiment configured of one first developing roller 24 achieves a desired developing performance with an image directionality at a tolerable level. However, at processing speeds exceeding 300 mm/s, the developing device 20 having just one first developing roller 24 is unlikely to attain a desired developing performance. If the ratio of circumferential speeds of the first developing roller 24 to the photosensitive drum 11 is increased in an attempt to achieve a desired developing performance, the bristles of the developer 3 rub the surface of the photosensitive drum 11 harder, making it difficult to produce images having a desired level of directionality. In the preferred embodiment, the developing device 120 having the construction described above can produce desired images, even when the processing speed exceeds 300 mm/s.

Next, an electrostatic recording device 201 and a developing device 220 according to a third embodiment of the present invention will be described with reference to FIG. 9. Since the electrostatic recording device 201 of the third embodiment has a structure identical to that of the electrostatic recording device 101 in the second embodiment, except for the structure of the developing device 220, only the developing device 220 will be described below. The developing device 220 according to the third embodiment differs from the developing device 120 in the second embodiment in that a conveying pole S3 is disposed adjacent to the conveying pole S1 on the upstream side with respect to the rotational direction of the sleeve roller 24B. The polarity of the S3 pole is the same as the polarity of the S1 pole.

Figure 9:
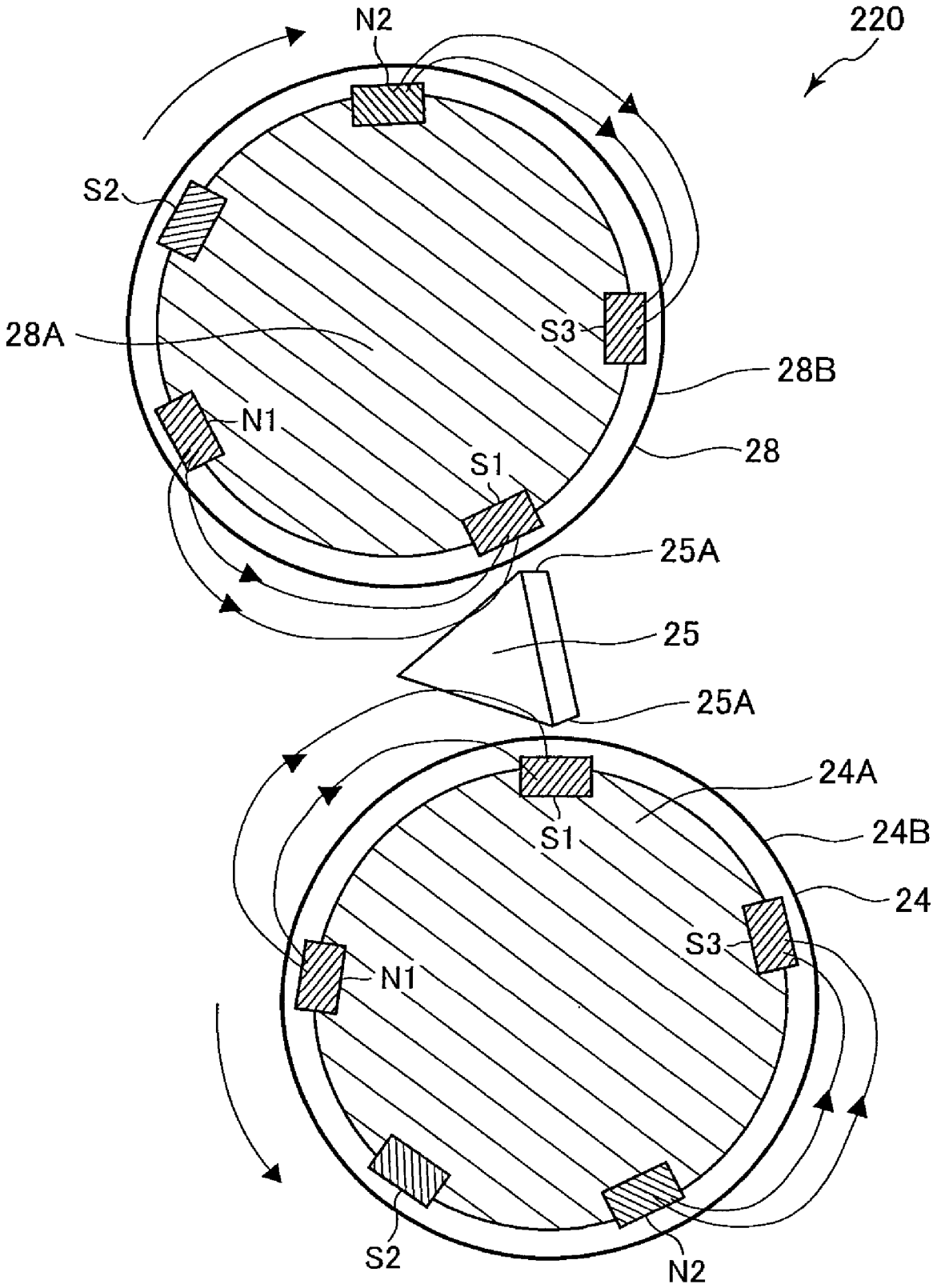
FIG. 9 is a cross-sectional view of a developing roller in the developing device according to a third embodiment showing the magnetic lines of force generated by the developing roller.

In the first developing roller 24 of the developing device 220, five permanent magnets are arranged counterclockwise in FIG. 9 in the order of poles S1, N1, S2, N2, and S3. In the second developing roller 28, the five permanent magnets are arranged clockwise in FIG. 9 in the order of poles S1, N1, S2, N2, and S3.

The developing device 220 having this construction can prevent the generation of magnetic lines of force from one of the first developing roller 24 and second developing roller 28 to the other, for example magnetic line of force from the N3 pole of the first developing roller 24 to the S1 pole of the second developing roller 28 in the second embodiment. The developing device 220 can also prevent the generation of magnetic lines of force from the S1 pole to the S3 pole on both the first developing roller 24 and the second developing roller 28. Hence, the magnetic binding force acting on the developer 3 weaken in narrow areas 25A between the sleeve roller 24B and the developer conveying quantity regulating member 25 and between the sleeve roller 28B and the developer conveying quantity regulating member 25 only by the magnetic force between the respective conveying pole S1 and the conveying pole N1. As a result, the amount of stress applied to the developer 3 can be reduced.

While the invention has been described in detail with reference to specific embodiments thereof, it would be apparent to those skilled in the art that many modifications and variations may be made therein without departing from the spirit of the invention, the scope of which is defined by the attached claims. The recording member for conveying an image is not limited to the photosensitive drum 11 used in the preferred embodiment described above. For example, it is possible to use a photosensitive belt or the like that moves around a prescribed path.

Further, while the two developing rollers 24 and 28 were used in the second embodiment described above, the developing device may be configured with a plurality of developing rollers disposed upstream of the second developing roller 28 with respect to the rotational direction of the photosensitive drum 11. Alternatively, the developing device may be configured with a plurality of developing rollers disposed downstream of the first developing roller 24 with respect to the rotational direction of the photosensitive drum 11.

The developing device and electrostatic recording device of the present invention can be applied to an electrophotographic printer, copier, or the like that performs color printing or prints at a high rate of speed and consumes a large amount of toner, or any device that magnetically conveys powder capable of taking on a charge while regulating the height of bristles formed with the powder.

What is claimed is:

1. An electrostatic recording device, comprising:

a substantially cylindrical recording member, having a rotational axis and arranged to be rotatable about the rotational axis, having a peripheral surface on which an electrostatic latent image is formed and developer is deposited;

a charging unit for charging the recording member;

an exposing unit for irradiating light onto the charged recording member;

a developing device for supplying toner to the recording member to form a toner image thereon; and a transferring unit for transferring the toner image onto a recording medium, wherein the developing device comprises:

a developer-accommodating vessel for accommodating developer having a toner and a carrier as primary components;

a developer conveying member disposed in the developer accommodating vessel to convey the developer in a direction along the rotational axis; and a developing roller opposing at one side the recording member and at another side the developer conveying member and having an axis, the developing roller comprising a cylindrical part having a peripheral surface and a plurality of magnets of differing polarity, and a sleeve roller disposed on the peripheral surface of the cylindrical part and capable of rotating about the axis for supplying the developer from the developer conveying member to the recording member, wherein the carrier has an average particle size of not greater than 65 μm and a saturation magnetization of not less than 70 emu/g, wherein the surface of the sleeve roller has a roughness of not less than 0.45 times the average particle size of the carrier, wherein one of the magnets is disposed in opposition to the recording member in the cylindrical part, the one of the magnets having a maximum magnetic-flux density of not less than 0.07 T and, wherein a relationship $10*V(cm/s)*L(cm)*M(g/cm^2)<W(g/s)<40*V(cm/s)*L(cm)*M(g/cm^2)$ is met, where W is a flow rate of developer conveyed along the rotational axis of the developer conveying member, V is a circumferential velocity of the peripheral surface of the rotating recording member, L is a width of developer on the developing roller with respect to an axial direction of the developing roller, and M is an amount of toner on the recording member.

2. A developing device for developing an electrostatic latent image formed on a peripheral surface of a substantially cylindrical recording member having an axis and that is rotatable about the axis, the developing device comprising:

a developer accommodating vessel for accommodating developer having a toner and a carrier as primary components;

a developer conveying member disposed in the developer accommodating vessel to be rotatable about a rotational axis to convey the developer in a direction; and a developing roller opposing at one side the recording member and at another side the developer conveying member and having an axis, the developing roller comprising a cylindrical part having a peripheral surface and a plurality of magnets of differing polarity, and a sleeve roller disposed on the peripheral surface of the cylindrical part and arranged to be rotatable about said axis for supplying the developer from the developer conveying member to the recording member;

wherein the carrier has an average particle size of not greater than 65 μm and a saturation magnetization of not less than 70 emu/g, the surface of the sleeve roller has a roughness of not less than 0.45 times an average particle size of the carrier, wherein one of the magnets is disposed in opposition to the recording member in the cylindrical part, the one of the magnets having a maximum magnetic-flux density of not less than 0.07 T, and wherein a relationship $10*V(cm/s)*L(cm)*M(g/cm^2)<W(g/s)<40*V(cm/s)*L(cm)*M(g/cm^2)$ is met, where W is a flow rate of developer conveyed along the rotational axis of the developer conveying member, V is a circumferential velocity of the peripheral surface of the rotating recording member, L is a width of developer on the developing roller with respect to an axial direction of the developing roller, and M is an amount of toner on the recording member.

3. The developing device of claim 2, wherein the carrier has a core material having magnetite.

4. A developing device for developing an electrostatic latent image formed on a peripheral surface of a substantially cylindrical recording member having an axis and that is rotatable about the axis, the developing device comprising:

a developer accommodating vessel for accommodating developer having a toner and a carrier as primary components;

a developer conveying member disposed in the developer accommodating vessel to be rotatable about a rotational axis to convey the developer in a direction; and a developing roller opposing at one side the recording member and at another side the developer conveying member and having an axis, the developing roller comprising a cylindrical part having a peripheral surface and a plurality of magnets of differing polarity, and having a sleeve roller disposed on the peripheral surface of the cylindrical part and arranged to be rotatable about said axis for supplying the developer from the developer conveying member to the recording member, wherein the carrier has an average particle size of not greater than 65 μm and a saturation magnetization of not less than 70 emu/g, wherein the surface of the sleeve roller has a roughness of not less than 0.45 times an average particle size of the carrier; and wherein a relationship $10*V(cm/s)*L(cm)*M(g/cm^2)<W(g/s)<40*V(cm/s)*L(cm)*M(g/cm^2)$ is met, where W is a flow rate of toner conveyed along the rotational axis of the developer conveying member, V is a circumferential velocity of the peripheral surface of the rotating recording member, L is a width of developer on the developing roller with respect to an axial direction of the developing roller, and M is an amount of toner on the recording member.

5. The developing device of claim 4, wherein the carrier has a core material having magnetite.

6. A developing device for developing an electrostatic latent image formed on a peripheral surface of a substantially cylindrical recording member having an axis and that is rotatable about the axis, the developing device comprising:

a developer accommodating vessel for accommodating developer having a toner and a carrier as primary components;

a developer conveying member disposed in the developer accommodating vessel to be rotatable about a rotational axis to convey the developer in a direction; and a first developing roller opposing at one side the recording member and at another side the developer conveying member;

a second developing roller opposing at one side the recording member;

wherein the first developing roller has an axis and comprises a cylindrical part having a peripheral surface and includes a plurality of first developing roller magnets of differing polarity, and includes a sleeve roller disposed on the peripheral surface of the cylindrical part and arranged to be rotatable about said axis for supplying the developer from the developer conveying member to the second developing roller and the recording member, wherein the second developing roller has an axis and comprises a cylindrical part having a peripheral surface and includes a plurality of second developing roller magnets of differing polarity, and includes a sleeve roller disposed on the peripheral surface of the cylindrical part and arranged to be rotatable about said axis for supplying the developer from the first developing roller to the recording member, wherein the carrier has an average particle size of not greater than 65 μm and a saturation magnetization of not less than 70 emu/g; and the surface of the sleeve roller has a roughness of not less than 0.45 times an average particle size of the carrier, wherein the sleeve roller of the first developing roller is arranged to be rotatable in the same direction as the rotational direction of the recording member, wherein the sleeve roller of the second developing roller is arranged to be rotatable in the opposite direction to the rotational direction of the recording member, wherein one of the first developing roller magnets is disposed in opposition to the recording member, and the one of the first developing roller magnets has a maximum magnetic-flux density of not less than 0.07 T, wherein one of the second developing roller magnets is disposed in opposition to the recording member, and the one of the second developing roller magnets has a maximum magnetic-flux density of not less than 0.07 T, and wherein a relationship $10*V(cm/s)*L(cm)*M(g/cm^2)<W(g/s)<40*V(cm/s)*L(cm)*M(g/cm^2)$ is met, where W is a flow rate of toner conveyed along the rotational axis of the developer conveying member, V is the circumferential velocity of the peripheral surface of the rotating recording member, L is the width of developer on the first developing roller and second developing roller with respect to their axial direction, and M is an amount of toner on the recording member.

7. The developing device of claim 6, wherein the carrier has a core material having magnetite.

8. A developing device for developing an electrostatic latent image formed on a peripheral surface of a substantially cylindrical recording member having an axis and that is rotatable about the axis, the developing device comprising:

a developer accommodating vessel for accommodating developer having a toner and a carrier as primary components;

a developer conveying member disposed in the developer accommodating vessel to convey the developer in a direction; and a first developing roller opposing at one side the recording member and at another side the developer conveying member; and a second developing roller opposing at one side the recording member, wherein the first developing roller has an axis and comprises a cylindrical part having a peripheral surface and includes a plurality of first developing roller magnets of differing polarity, and includes a sleeve roller disposed on the peripheral surface of the cylindrical part and arranged to be rotatable about said axis for supplying the developer from the developer conveying member to the second developing roller and the recording member, wherein the second developing roller has an axis and comprises a cylindrical part having a peripheral surface and includes a plurality of second developing roller magnets of differing polarity, and includes a sleeve roller disposed on the peripheral surface of the cylindrical part and arranged to be rotatable about said axis for supplying the developer from the first developing roller to the recording member, wherein the carrier has an average particle size of not greater than 65 μm and a saturation magnetization of not less than 70 emu/g, wherein the surface of the sleeve roller has a roughness of not less than 0.45 times an average particle size of the carrier, wherein the sleeve roller of the first developing roller is arranged to be rotatable in the same direction as the rotational direction of the recording member, wherein the sleeve roller of the second developing roller is arranged to be rotatable in the opposite direction to the rotational direction of the recording member, wherein a relationship $10*V(cm/s)*L(cm)*M(g/cm^2)<W(g/s)<40*V(cm/s)*L(cm)*M(g/cm^2)$ is met, where W is a flow rate of toner conveyed along the rotational axis of the developer conveying member, V is the circumferential velocity of the peripheral surface of the rotating recording member, L is the width of developer on the first developing roller and second developing roller with respect to their axial direction, and M is an amount of toner on the recording member.

9. The developing device of claim 8, wherein the carrier has a core material having magnetite.

* * * * *